US005425245A

United States Patent [19]

Martin et al.

[11] Patent Number: 5,425,245

[45] Date of Patent: Jun. 20, 1995

[54] REFRIGERATOR WITH IMPROVED CONTROL MECHANISM

[75] Inventors: Jerry C. Martin, Corydon, Ind.; Martin M. Zentner; Bruce L. Ruark, both of Louisville, Ky.

[73] Assignee: General Electric Company, Louisville, Ky.

[21] Appl. No.: 207,375

[22] Filed: Mar. 4, 1994

[51] Int. Cl.[6] ..... F25D 17/04

[52] U.S. Cl. ..... 62/187; 62/229

[58] Field of Search ..... 62/180, 187, 229

[56] References Cited

U.S. PATENT DOCUMENTS 4,009,591 3/1977 Hester ..... 62/187 X 4,936,106 6/1990 Beach, Jr. et al. ..... 62/187 X

*Primary Examiner*—William E. Wayner

*Attorney, Agent, or Firm*—H. Neil Houser

[57] ABSTRACT

A mechanism to control the temperature in the freezer and fresh food compartments of a side-by-side refrigerator includes an elongated support plate mounted in the upper portion of the fresh food compartment. A fresh food thermostat is mounted under the plate adjacent to the mullion separating the compartments and its control shaft is aligned with an opening in the plate. A pinion gear is connected to the shaft and is positioned above the plate. A freezer thermostat is mounted under the plate at a position more remote from the mullion and its control shaft is aligned with an opening in the plate. A pinion gear is connected to the control shaft and is positioned above the plate. A fresh food rack gear is slidingly mounted on the plate remote from the mullion and includes an elongated arm with teeth that engage the fresh food pinion gear. A freezer rack gear is slidingly mounted on the plate close to the mullion and includes an elongated arm with teeth that engage the teeth on the freezer pinion gear. Each rack gear includes a tab for user movement of that rack gear to adjust the setting of the corresponding thermostat.

9 Claims, 3 Drawing Sheets

REFRIGERATOR WITH IMPROVED CONTROL MECHANISM

BACKGROUND OF THE INVENTION

This invention relates to refrigerators and, more particularly, to an improved mechanism for controlling the temperature in freezer and fresh food storage compartments of side-by-side refrigerators.

Side-by-side type refrigerators include a freezer compartment and a fresh food storage compartment arranged in a side-by side relationship. Typically the refrigerator includes only a single evaporator, that is located in the freezer. A freezer thermostat includes a bulb positioned in the freezer to sense the temperature in the freezer and operate the refrigeration system in order to maintain the freezer temperature in the desired range. The fresh food compartment is maintained in the desired temperature range by a thermostat which is positioned to sense the temperature in that compartment and control a mechanism for permitting an appropriate amount of cold air to flow from the freezer to the fresh food compartment.

For the convenience of the user, it is preferred to place both the freezer and fresh food thermostats and their operating mechanisms in the fresh food compartment. In addition it is preferred to place these mechanisms, along with the light for the fresh food compartment, in a composite arrangement that extends across the upper rear portion of the fresh food compartment. Since the fresh food thermostat is connected to a mechanical mechanism for controlling the air flow from the freezer to the fresh food compartment, that thermostat is best located adjacent the mullion. This results in the freezer thermostat being positioned further away from the mullion, and thus further away from the freezer.

The natural assumption of a user is that the control mechanism closest to the freezer operates the freezer thermostat. Thus if the operating devices manipulated by the user to set the thermostats are placed adjacent to the thermostats, the user will be inclined to adjust the incorrect thermostat and obtain unsatisfactory operation of the refrigerator. Thus there is a need to provide the user with operating or thermostat setting devices which are arranged in the same orientation or relationship as the storage compartments, even though the thermostats themselves are in the opposite orientation. For example, when the freezer is to the left of the fresh food compartment, it is desirable that the knob, lever or other device to operate the freezer thermostat be located to the left of the device to operate the fresh food thermostat, even though the freezer thermostat is located to the right of the fresh food thermostat.

It is an object of this invention to provide a refrigerator with an improved mechanism for controlling the temperature in the freezer and fresh food storage compartments.

It is another object to provide such an improved mechanism in which the user operated device for setting or controlling a thermostat is remote from the thermostat.

It is yet another object of this invention to provide a side-by-side refrigerator with such an improved mechanism in which the user operated devices have the same relationship as the freezer and fresh food compartments, even though the thermostats have the opposite relationship.

SUMMARY OF THE INVENTION

In accordance with one embodiment of this invention a refrigerator includes a liner defining a freezer compartment and a fresh food compartment in side-by-side relationship and separated by a mullion. A control assembly for the refrigerator includes an elongated support plate extending horizontally across the fresh food compartment transverse to the mullion. The plate has a first opening closer to the mullion and a second opening more remote from the mullion.

A first thermostat, for controlling the temperature in the fresh food compartment, is mounted under the plate and includes a first rotary control shaft aligned with the first opening. A first pinion gear is positioned above the plate, aligned with first opening and is connected to the first control shaft for rotation therewith. A first rack gear includes a base, slidably connected to a portion of the plate remote from the mullion, and an elongated arm extending toward the mullion and engaging the first pinion gear for rotation of the first thermostat control shaft in response to sliding movement of the first rack gear.

A second thermostat, for controlling the temperature in the freezer compartment, is mounted under the plate and includes a second rotary control shaft aligned with the second opening. A second pinion gear is positioned above the plate, aligned with the second opening and connected to the second control shaft for rotation therewith. A second rack gear includes a base slidably connected to a portion of the plate adjacent said mullion and an elongated arm extending away from the mullion and engaging the second pinion gear for rotation of the second thermostat shaft in response to sliding movement of the second rack gear.

DETAILED DESCRIPTION OF PREFERRED EMBODIMENT

Figure 1:
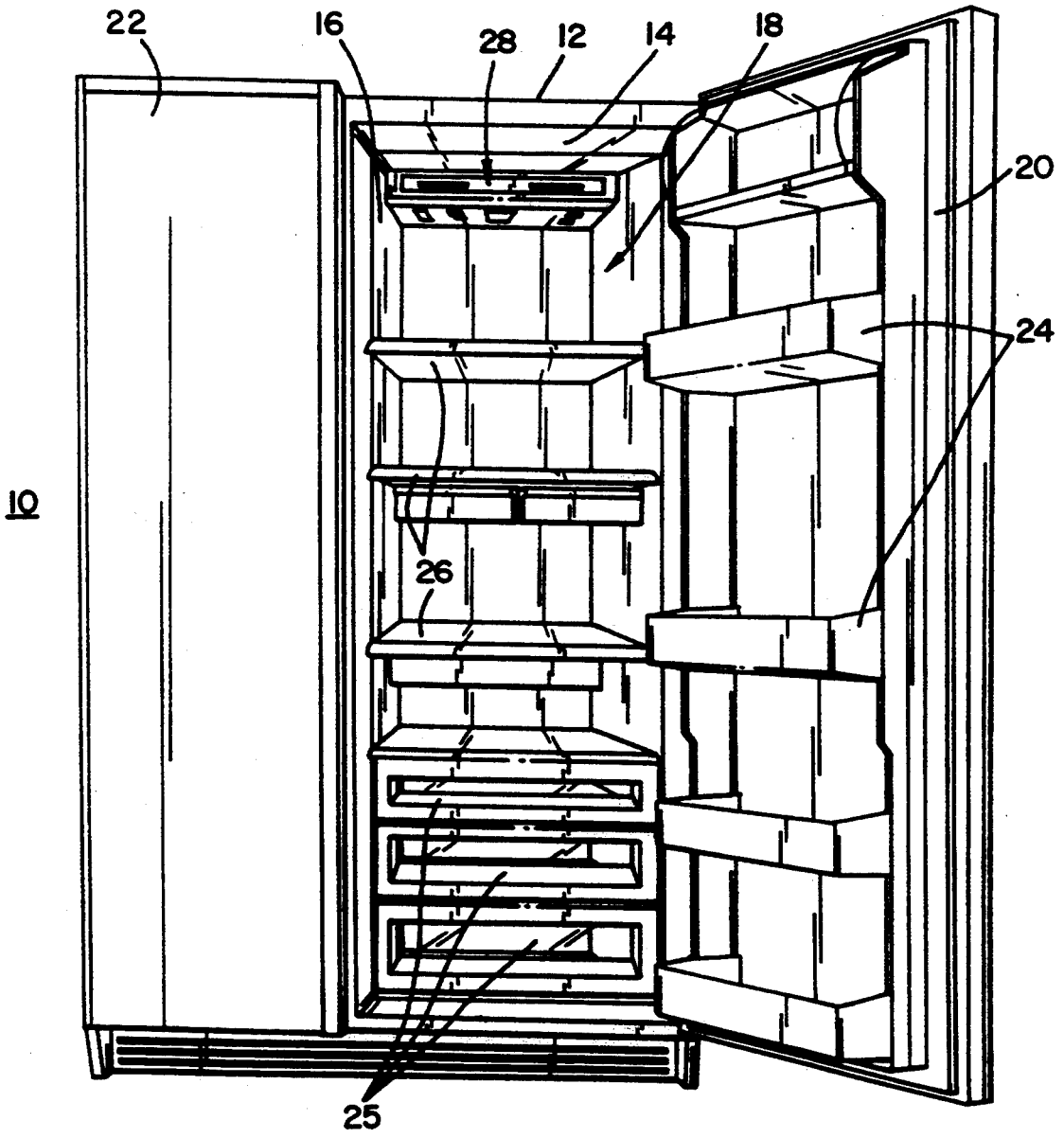
FIG. 1 is a simplified front perspective view of a side-by-side type refrigerator, with the door for the fresh food compartment open for purposes of illustration.
Figure 3:
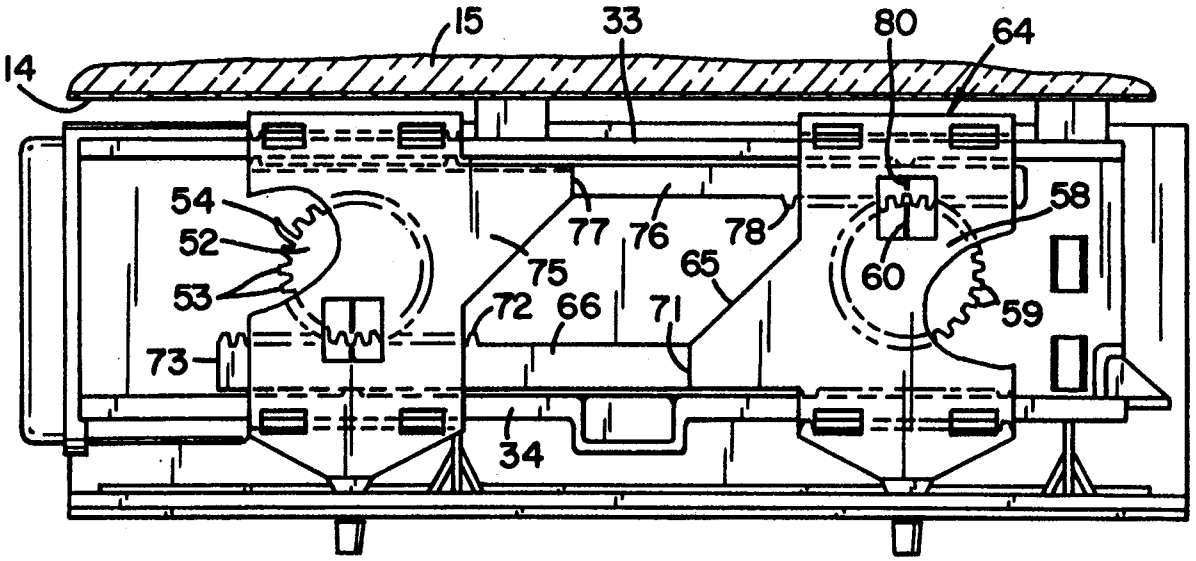
FIG. 3 is a plan view of the control mechanism of FIG. 2, with the view being somewhat simplified and with some parts omitted for the sake of simplicity.
Figure 4:
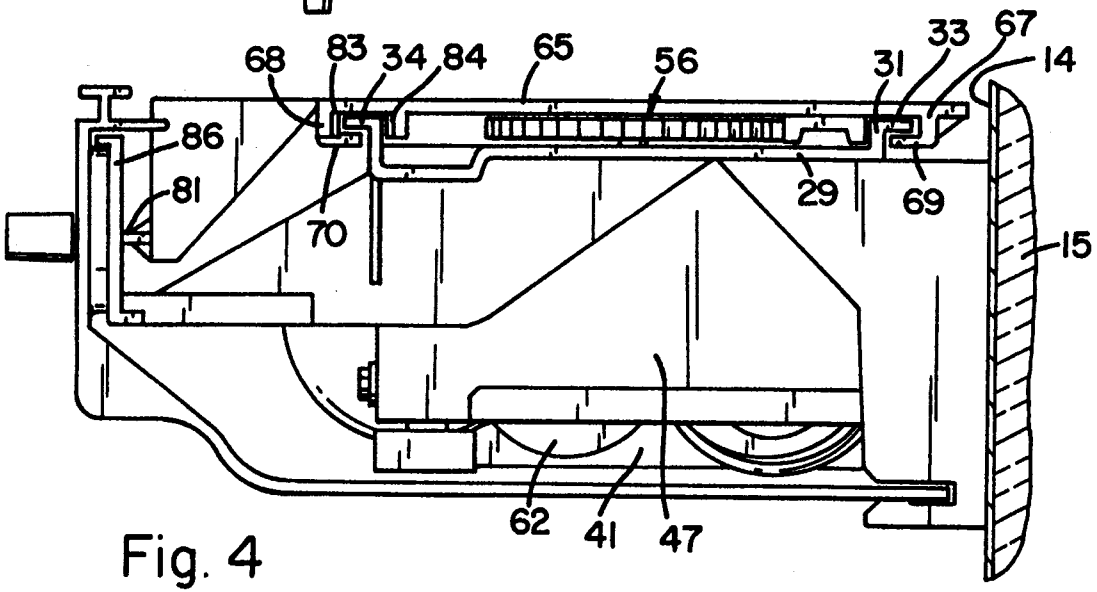
FIG. 4 is an end elevation view of the control mechanism of FIGS. 2 and 3, with the view being somewhat simplified and with some parts omitted for the sake of simplicity.

Referring now to FIG. 1, there is illustrated a side-by-side refrigerator/freezer type of refrigerator 10 having an outer cabinet 12 and inner liner 14 separated by a suitable insulation 15 (see FIGS. 3,4). The liner 14 and a mullion 16 divide the interior of the refrigerator into a fresh food compartment 18 and a freezer compartment, not shown, arranged in a side-by-side relationship or configuration. Access to the fresh food compartment is provided by a fresh food door 20 and access to the freezer compartment is provided by a freezer door 22. Conveniently, the doors 20, 22 are provided with a number of shelves, such as those shown at 24. Conveniently the fresh food compartment is provided with storage drawers 25 and shelves 26. It will be understood that the freezer compartment also normally is provided with shelves and, in at least some models, with drawers.

Figure 2:
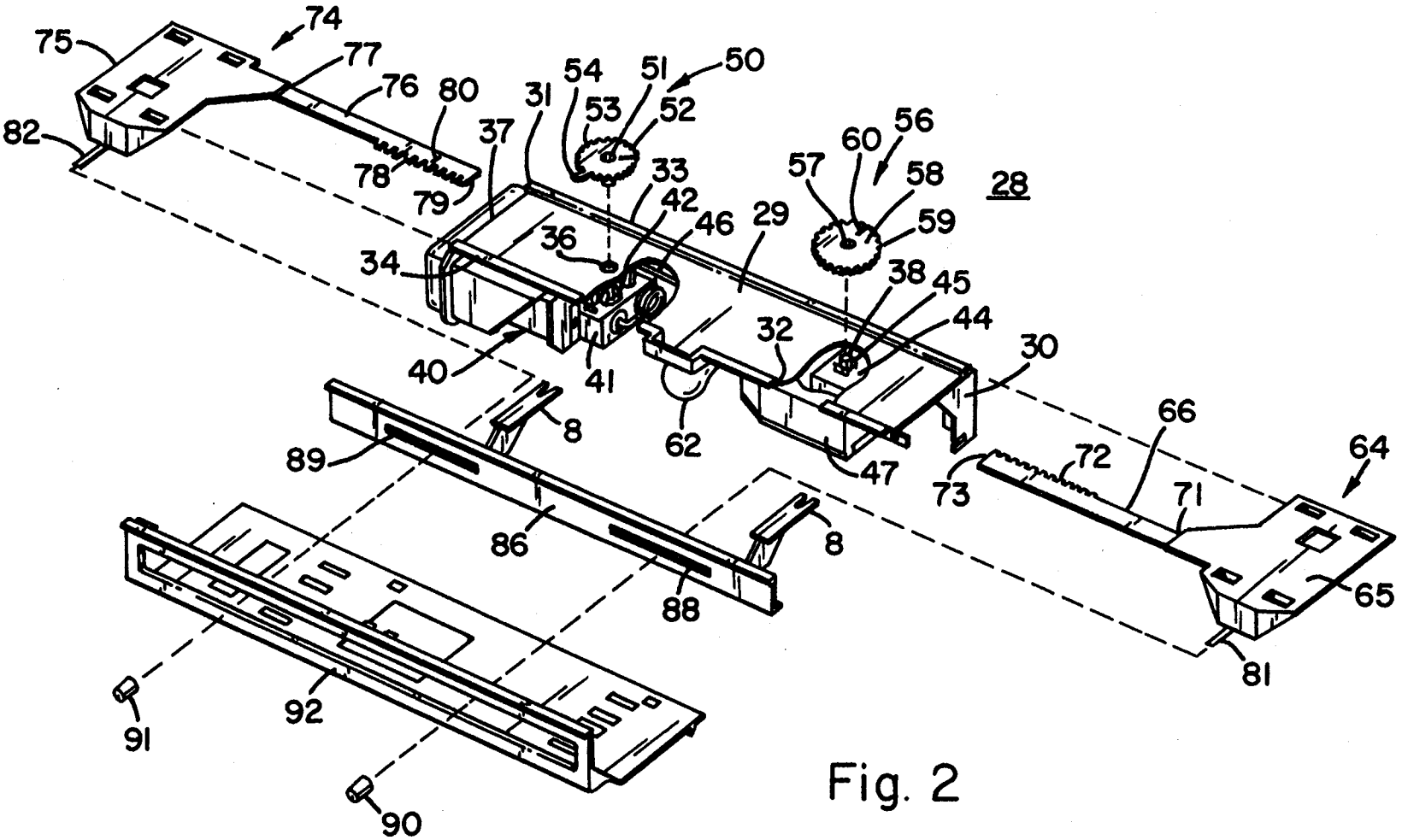
FIG. 2 is an exploded view of the control mechanism for the refrigerator of FIG. 1, with the view being somewhat simplified and with some parts omitted for the sake of simplicity.

A control mechanism, generally indicated at 28, is disposed near the top of the fresh food compartment 18 and extends across the compartment transverse to the mullion 16. The mechanism 28 includes a number of operative components, such as the thermostats for controlling the temperature in each compartment and a light to illuminate the fresh food compartment. Referring now more particularly to FIG. 2, control mechanism 28 includes a frame having an elongated, generally planar plate 29 with integral mounting feet 30 along one edge molded from a suitable plastic material, such as the polycarbonate sold by General Electric Company under the name LEXAN. The feet 30 are used to mount the frame to the liner 14 in the upper portion Of the fresh food compartment 16, with the plate in a horizontal orientation and extending transverse to the mullion 16 (see FIG. 1). The front and rear edges of the plate 29 have longitudinal ribs 31,32 which project vertically upward. Flanges 33,34 project outwardly of the upper edges of the ribs 31,32 respectively. Thus the flanges 33,34 are spaced above the upper surface of and extend longitudinally along the front and rear edges of plate 29. A first opening 36 is provided in the plate relatively close to the mullion end 37 of the plate. A second opening 38 is provided in the plate at a position substantially more remote from the mullion.

An air flow control mechanism 40, including a fresh food thermostat 41, is mounted to the under side of plate 29. The thermostat 41 is positioned so that its rotary control shaft 42 projects vertically in alignment with the first opening 36. The air flow control mechanism controls the amount of cold air which flows from the freezer to the fresh food compartment so as to control the temperature in the fresh food compartment. Rotation of the shaft 42 adjusts the setting of the thermostat and thus the controlled temperature in the fresh food compartment. Additional details of the assembly and operation of the air flow control mechanism 40 may be had by reference to co-pending application Ser. No. 08/207,379 now U.S. Pat. No. 5,385,032, Martin et al, entitled Refrigerator Air Flow Control Mechanism, which is assigned to General Electric Company, assignee of the present invention, and which is hereby incorporated herein by reference.

A freezer thermostat 44 which controls the refrigeration system, is mounted to the under side of plate 29 in a position so that its rotary control shaft 45 extends vertically in alignment with the opening 38. The capillary tube 46 of thermostat 44 extends across the under side of plate 29 and into the freezer compartment. Rotation of the shaft 45 adjusts the setting of the thermostat 44 and thus the controlled temperature in the freezer compartment. Conveniently a housing 47 mounted to the under side of plate 29 surrounds thermostat 44 to protect it.

A first pinion gear 50 is connected to fresh food thermostat control shaft 42 for rotation therewith. Conveniently the shaft 42 may have a "D" shaped cross section configuration and a mating portion of the central opening 51 in gear 50 may have a mating shape. Thus when the pinion gear 50 is rotated, it rotates the shaft 42. Conveniently the gear 50 may include a short stub shaft, not shown, that extends downwardly and includes a "D" cross section part of the opening 51 to receive the thermostat shaft 42. The exact configuration of the shaft 42 and mating portion of pinion gear is not critical, so long as the gear and shaft are operatively connected and the main body 52 of pinion gear 50 is positioned above the upper surface of the plate 29. Preferably the main body 52 is in the form of a flat disk with a series of external teeth 53 around its outer perimeter or periphery. As will be explained in more detail hereafter, a finger 54 projects radially outwardly of the main body 52 at a predetermined position.

A second pinion gear 56 is connected to freezer thermostat control shaft 45 for rotation therewith. Conveniently the shaft 45 may have a "D" shaped cross section configuration and a mating portion of the central opening 57 in gear 56 may have a mating shape. Thus, when the pinion gear 56 is rotated, it rotates the shaft 45. Conveniently the gear 56 may include a short stub shaft, not shown, that extends downwardly and includes a "D" shaped cross section part of the opening 57 to receive the thermostat shaft 45. The exact configuration of the shaft 45 and mating portion of pinion gear 56 is not critical, so long as the gear and shaft are operatively connected and the main body 58 of pinion gear 56 is positioned above the upper surface of the plate 29. Preferably the main body 58 is in the form of a flat disk with a series of external teeth 59 around its outer perimeter or periphery. As will be explained in more detail hereafter, a visual indicia, for example radial line 60, is provided at a predetermined position on the upper surface of pinion gear 56.

The fresh food thermostat 41 is positioned adjacent to the mullion in order to simplify the mechanism for controlling the passage of cold air from the freezer to the fresh food compartment. The freezer thermostat then, of necessity, is positioned further away from the mullion (and the freezer). In the exemplification embodiment it is positioned toward the opposite end of the plate 29 to provide space for a central mounting of a lamp 62, used to illuminate the interior of the fresh food compartment.

Referring now to FIGS. 2–4, the first pinion gear 50 is rotated by a first rack gear 64. The rack gear 64 includes a base portion 65 and an elongated projecting arm 66 integrally molded from a suitable plastic material, such as LEXAN polycarbonate. The front and rear edges of the base 65 are formed with downwardly projecting ribs 67,68 that terminate in inwardly projecting flanges 69,70. Referring particularly to FIGS. 3–4, the base is mounted on top of the plate 29 with the flanges 33,34 of the plate interfitting with the flanges 69,70 of the base 65. The base 65 is supported by the flanges 33,34 in a position to pass over the top of second pinion gear 56 as rack gear 64 slides along plate 29. The arm 66 is off set downwardly of the base 65 at 71, so that it slides along plate 29 and is guided by rib 32. A number of teeth 72 are formed on the inner edge of arm 66 in an area remote from base 65 and adjacent the distal end 73 of the arm.

The mating "D" cross section configurations of opening 51 in first pinion gear 50 and control shaft 42 of fresh food thermostat 40 assure that they have a predetermined angular relationship. The pinion gear is rotated until the finger 54 is transverse to the plate 29 and points directly toward rib 32. Then rack gear 64 is mounted over the right end of plate 29 (as seen in FIGS. 2–3) and moved toward pinion gear 50. The distal end 73 of arm 66 engages finger 54 and rotates pinion gear 50 so that the teeth 53 and 73 mesh in a predetermined relationship. This assures that the positions of the rack gear always correspond to predetermined settings of fresh food thermostat 41.

Referring now to FIGS. 2–4, the second pinion gear 56 is rotated by a second rack gear 74. The rack gear 74 is substantially similar to rack gear 64. It includes a base portion 75 and an elongated projecting arm 76 integrally molded from a suitable plastic material, such as LEXAN polycarbonate. The front and rear edges of the base 65 are formed with downwardly projecting ribs that terminate in inwardly projecting flanges, in the same manner as rack gear 64. The base 75 is mounted on top of the plate 29 with its flanges interfitting with the flanges 33,34 of the plate 29. The base 75 is supported by the flanges 33,34 in a position to pass over the top of first pinion gear 50 as rack gear 74 is slides along plate 29. The arm 76 is off set downwardly of the base 75 at 77, so that it slides along plate 29 and is guided by rib 31. A number of teeth 78 are formed on the inner edge of arm 76 in an area remote from base 75 and adjacent the distal end 79 of the arm. An indicia, in the form of a cross line 80, is placed on arm 76 in a predetermined position along the teeth 78.

The mating "D" cross section configuration of the opening 57 in second pinion gear 56 and control shaft 45 of freezer thermostat 44 assure that they have a predetermined angular relationship. The pinion gear 56 is rotated until the radial line 60 is transverse to the plate 29 and points directly toward rib 31. Then rack gear 74 is mounted over the left end of plate 29 (as seen in FIGS. 2–3) and moved toward pinion gear 56. As the distal end 79 of arm 76 approaches pinion gear 56 the arm is flexed upwardly until the radial line 60 and cross line 80 are aligned. The arm 76 is then released and the teeth 59 and 78 mesh in a predetermined relationship. This assures that the positions of the rack gear 74 always correspond to predetermined settings of fresh food thermostat 41.

It will be seen from FIG. 3, that when fully assembled, the rack gears overlap, that is base portion 65 of gear 64 is over arm 76 of gear 74 and base portion 75 of gear 74 is over arm 66 of gear 64. This assures that the arms do not accidentally become disengaged form the pinion gears. However it also dictates that second rack gear 74 is mounted on plate 29 before first rack gear 64 so that the arm 76 can be flexed to properly engage teeth 59 and 78.

Rack gear 64 includes a tab or finger 81 which is grasped by an user to slide the gear 64 longitudinally along plate 29. As the gear 64 moves it rotates pinion gear 50 which, in turn, rotates shaft 42 to adjust the temperature setting of the thermostat 41. Similarly, rack gear 74 includes a tab or finger 82 which is grasped by an user to slide the gear 74 longitudinally of the plate to adjust the setting of freezer thermostat 44.

It will be seen that the mechanism, as illustrated and described, provides the user operated thermostat controls with the same relative side-by-side relationship as the compartments, even though the thermostats have an opposite relationship. In the exemplification, the freezer is to the left of the fresh food compartment and the freezer adjustment finger 82 is to the left of the fresh food adjustment finger 81, even though the freezer thermostat 44 is to the right of the fresh food thermostat 42.

Figure 5:
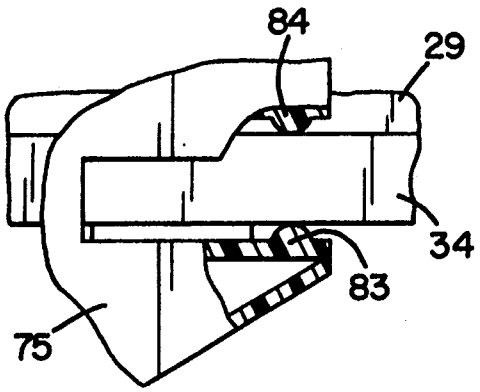
FIG. 5 is a fragmentary plan view of a portion of the mechanism of FIGS. 2–4, illustrating certain details.

As best seen in FIGS. 4 and 5, each of the rack gear bases 65,75 include bosses 83,84 that engage the flange 34 of plate 29. This provides a limited number of essentially point or line areas of sliding contact between the rack gears and the plate for smooth non-binding movement of the rack gears along the, plate.

A bezel 86 is mounted in front of plate 29 by split fingers 87 which fit around tabs, not shown, on the support structure. The bezel 86 includes a pair of spaced apart, elongated slots 88,89 through which the tabs 81,82 extend for manipulation by an user. If desired small, decorative buttons 90,91 can be inserted over the ends of the tabs 81,82, after they are inserted through the slots 88,89. A bottom cover 92 is mounted on the main support and encloses the various operating components. Additional details as to the assembly of the bezel and bottom cover, as well as their inter-relationship with other components may be had by reference to co-pending application Ser. No. 08/207,373 now U.S. Pat. No. 5,388,418, Martin et al, entitled Refrigerator With Improved Control Mechanism, which is assigned to General Electric Company, assignee of the present invention, which application is hereby incorporated herein by reference.

While a specific embodiment of the invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator having a liner, defining a fresh food compartment and a freezer compartment in side-by-side relationship and separated by a mullion, and a control assembly including;

an elongated support plate extending horizontally within said fresh food compartment transverse to said mullion; said plate including a first opening therein closer to said mullion and a second opening therein more remote from said mullion;

a first thermostat, for controlling the temperature in said fresh food compartment, mounted under said plate and including a rotary control shaft aligned with said first opening;

a first pinion gear positioned above said plate, aligned with said first opening and operatively connected to said first thermostat control shaft for rotation therewith;

a second thermostat, for controlling the temperature in said freezer compartment, mounted under said plate and including a rotary control shaft aligned with said second opening;

a second pinion gear positioned above said plate, aligned with said second opening and operatively connected to said second thermostat control shaft for rotation therewith;

a first rack gear including a base slidably connected to a portion of said plate remote from said mullion and an elongated arm extending toward said mullion and engaging said first pinion gear for rotation of said first thermostat control shaft in response to sliding movement of said first rack gear;

a second rack gear including a base slidably connected to a portion of said plate adjacent said mullion and an elongated arm extending away from said mullion and engaging said second pinion gear for rotation of said second thermostat control shaft in response to sliding movement of said second rack gear;

whereby said rack gear bases have the same side-by-side relationship as said fresh food and freezer compartments and said thermostats have a reverse side-by-side relationship.

2. A refrigerator as set forth in claim 1, wherein:

each pinion gear includes an externally toothed outer perimeter;

each rack gear arm includes a distal end remote from its base and a plurality of teeth adjacent its distal end mating with the external teeth of the corresponding pinion gear.

3. A refrigerator as set forth in claim 2, wherein:

one set of corresponding pinion and rack gears includes mating indicia for properly aligning the teeth of that set of rack and pinion gears, the other pinion gear includes a finger projecting outwardly of its periphery beyond its teeth to engage said distal end of the corresponding rack arm to properly align the teeth of that set of rack and pinion gears.

4. A refrigerator as set forth in claim 1, wherein:

each pinion gear has a thin disk configuration and lies close to the upper surface of said plate; and the base of each rack gear is positioned sufficiently above the upper surface of said plate to clear the adjacent pinion gear.

5. A refrigerator as set forth in claim 1, wherein:

said plate includes a pair of elongated, spaced apart flanges extending longitudinally of said plate transverse to said mullion;

said base of each rack gear includes a pair of elongated, spaced apart flanges having an interfitting relationship with said plate flanges for slidingly mounting each of said bases on said plate.

6. A refrigerator as set forth in claim 5, further wherein:

one set of corresponding pinion and rack gears includes mating indicia for properly aligning that set of rack and pinion gears, the other pinion gear includes a finger projecting outwardly of its periphery beyond its teeth to engage said distal end of the corresponding rack arm to properly align that set of rack and pinion gears and wherein;

said one pinion gear is positioned with its indicia adjacent the path of travel of said one rack gear arm, said one rack gear is mounted on said plate with its flanges interfitting with said flanges on said plate and is moved longitudinally of said plate until its indicia is aligned with said indicia of said one pinion gear and said teeth of said one rack gear and said one pinion gear are engaged;

said other pinion gear is positioned so that its finger projects across the path of travel of said other rack gear arm, said other rack gear is mounted on said plate with its flanges interfitting with said flanges on said plate and is moved longitudinally of said plate until said distal end of said other rack gear engages said finger and rotates said other pinion gear sufficiently that said teeth of said other rack and pinion gears engage.

7. A refrigerator as set forth in claim 1, wherein:

each of said rack gears includes means to be moved longitudinally by a user for rotating the corresponding thermostat control shaft to adjust the temperature setting of that thermostat.

8. A refrigerator having at least one food storage compartment and a control assembly including:

a support mounted within said food storage compartment, said support including an elongated plate with a rail spaced from, projecting parallel to and extending along each of two spaced apart edges of said plate; said plate also including an opening therethrough at a predetermined location;

a thermostat mounted to one side of said plate and including a rotatable control shaft for adjusting the temperature setting of said thermostat; said shaft projecting perpendicular to said plate and aligned with said opening;

a pinion gear mounted for rotation with said control shaft, said pinion gear including a periphery positioned on the other side of said plate and having a plurality of external teeth;

a rack gear having a base portion with a pair of rails spaced therefrom and extending in parallel relationship; said base portion being mounted on said other side of said plate with said base rails and said plate rails in interfitting relationship for sliding movement of said base along said plate;

said rack gear also having an elongated arm extending parallel to its rails; said arm including a distal portion spaced from said base and including teeth meshing with said pinion gear teeth;

said rack gear base including means at a location remote from said thermostat for manual longitudinal movement of said rack gear to adjust the temperature setting of said thermostat.

9. A refrigerator as set forth in claim 8, wherein:

said plate also including a second opening therethrough at a predetermined location remote from said first opening;

a second thermostat mounted to said one side of said plate and including a second rotatable control shaft for adjusting the temperature setting of said second thermostat; said second shaft projecting perpendicular to said plate and aligned with said second opening;

a second pinion gear mounted for rotation with said second control shaft, said second pinion gear including a periphery positioned on said other side of said plate and having a plurality of external teeth;

a second rack gear having a second base portion with a pair of rails spaced therefrom and extending in parallel relationship; said second base portion being mounted on said other side of said plate with said second base portion rails and said plate rails in interfitting relationship for sliding movement of said second base along said plate;

said second rack gear also having a second elongated arm extending parallel to its rails; said second arm including a distal portion spaced from said second base and including teeth meshing with said second pinion gear teeth;

said second rack gear including means at a location remote from said second thermostat for manual longitudinal movement of said second rack gear to adjust the temperature setting of said thermostat.

* * * * *